US010279208B2

(12) United States Patent
Channer et al.

(10) Patent No.: US 10,279,208 B2
(45) Date of Patent: May 7, 2019

(54) MULTI-PURPOSE EXERCISE DEVICE

(71) Applicants: Ennevor Channer, Gaithersburg, MD (US); Faithlyn Channer, Gaithersburg, MD (US)

(72) Inventors: Ennevor Channer, Gaithersburg, MD (US); Faithlyn Channer, Gaithersburg, MD (US)

( * ) Notice: Subject to any disclaimer, the term of this patent is extended or adjusted under 35 U.S.C. 154(b) by 88 days.

(21) Appl. No.: 15/669,482

(22) Filed: Aug. 4, 2017

(65) Prior Publication Data

US 2018/0036571 A1 Feb. 8, 2018

Related U.S. Application Data

(60) Provisional application No. 62/370,787, filed on Aug. 4, 2016.

(51) Int. Cl.
*A63B 1/00* (2006.01)
*A63B 21/00* (2006.01)
(Continued)

(52) U.S. Cl.
CPC ..... *A63B 21/0023* (2013.01); *A63B 1/00* (2013.01); *A63B 21/00047* (2013.01); *A63B 21/1654* (2013.01); *A63B 21/4035* (2015.10); *A63B 23/0211* (2013.01); *A63B 23/0458* (2013.01); *A63B 23/1227* (2013.01); *A63B 23/1236* (2013.01); *A63B 23/03525* (2013.01); *A63B 2069/0062* (2013.01); *A63B 2208/0252* (2013.01); *A63B 2225/093* (2013.01)

(58) Field of Classification Search
CPC ..... A63B 21/0023; A63B 21/1654; A63B 21/00047; A63B 23/1236; A63B 1/00; A63B 21/4035; A63B 23/0458; A63B 23/1227; A63B 23/0211; A63B 2208/0252; A63B 2069/0062; A63B 23/03525; A63B 2225/093
See application file for complete search history.

(56) References Cited

U.S. PATENT DOCUMENTS 2,666,640 A * 1/1954 Jennings, Sr. ..... A63B 3/00 482/141
2,919,918 A * 1/1960 Horn ..... A63B 21/00047 482/142
(Continued)

*Primary Examiner* — Andrew S Lo
(74) *Attorney, Agent, or Firm* — Global Intellectual Property Agency, LLC; Daniel Boudwin

(57) ABSTRACT

A multi-purpose exercise device is provided. The exercise device includes an upright frame having a first support member and a second support member configured to support the exercise device in an upright and freestanding position, a first crossbar, a second crossbar, and a third crossbar oriented on the frame such that the crossbars conjunctively enable a user to perform push-ups, step-ups, and crunches with the same exercise device, a first support arm and a second support arm for facilitating wide-grip push-ups, a fourth crossbar including a bracket configured to engage the bottom rail of a door in order to secure and stabilize the exercise device to the door for performing exercises requiring the exercise bar to be fixed in place, and a height adjustment member disposed on the support members configured to extend vertically therefrom in order to adjust the height of the support members.

11 Claims, 4 Drawing Sheets

(51) Int. Cl.

| | |
|---|---|
| ***A63B 21/002*** | (2006.01) |
| ***A63B 23/12*** | (2006.01) |
| ***A63B 23/02*** | (2006.01) |
| ***A63B 23/04*** | (2006.01) |
| ***A63B 21/16*** | (2006.01) |
| *A63B 23/035* | (2006.01) |
| *A63B 69/00* | (2006.01) |

(56) References Cited

U.S. PATENT DOCUMENTS 3,121,551 A * 2/1964 Ancell ..... A47C 16/025 248/371
3,944,219 A 3/1976 LoPresti
4,232,863 A * 11/1980 Roach ..... A63B 21/00047 482/141
4,662,629 A * 5/1987 Plovie ..... A63B 21/00047 182/206
4,666,154 A * 5/1987 Lipscomb ..... A63B 21/00047 482/142
5,403,258 A * 4/1995 Hill ..... A63B 23/0211 482/140
5,407,404 A * 4/1995 Killian ..... A63B 21/0552 482/123
5,697,875 A * 12/1997 Stan ..... A63B 21/00047 482/141
5,961,430 A * 10/1999 Zuckerman ..... A63B 21/00047 482/141
6,248,048 B1 6/2001 Zuckerman et al.
6,551,224 B1 * 4/2003 Lim ..... A63B 23/0211 482/142
D593,169 S * 5/2009 Storch ..... D21/686
7,815,557 B1 * 10/2010 Almeda ..... A63B 23/1281 482/141
D686,287 S * 7/2013 Boatwright ..... D21/686
D701,581 S * 3/2014 Heitzman ..... D21/686
9,114,273 B2 * 8/2015 Kehoe ..... A63B 21/00047
9,339,688 B1 * 5/2016 Campbell ..... A63B 23/0205
9,868,006 B1 * 1/2018 Epler ..... A63B 1/00
2003/0004042 A1 * 1/2003 Burrell ..... A63B 21/00047 482/121
2005/0187083 A1 * 8/2005 Krystoff ..... A63B 21/00047 482/140
2009/0124471 A1 * 5/2009 Storch ..... A63B 21/00047 482/141
2009/0215594 A1 * 8/2009 Panaiotov ..... A63B 21/0552 482/130
2010/0137115 A1 * 6/2010 Storch ..... A63B 21/00047 482/141
2010/0234193 A1 * 9/2010 Friedman ..... A63B 1/00 482/133
2010/0292058 A1 11/2010 Barnes
2011/0053738 A1 * 3/2011 Osbourne ..... A63B 21/0552 482/122
2012/0046150 A1 * 2/2012 Stacey ..... A63B 1/00 482/131
2013/0184127 A1 * 7/2013 Eddy ..... A63B 21/002 482/91
2014/0287881 A1 * 9/2014 Wallisch ..... A63B 3/00 482/41
2014/0302968 A1 * 10/2014 Velikin ..... A63B 1/00 482/40
2015/0148197 A1 * 5/2015 Lentz ..... A63B 1/00 482/40
2015/0258359 A1 * 9/2015 Velikin ..... A63B 1/00 482/40

* cited by examiner

MULTI-PURPOSE EXERCISE DEVICE

CROSS REFERENCE TO RELATED APPLICATIONS

This application claims the benefit of U.S. Provisional Application No. 62/370,787 filed on Aug. 4, 2016. The above identified patent application is herein incorporated by reference in its entirety to provide continuity of disclosure.

BACKGROUND OF THE INVENTION

The present invention relates to exercise devices. More specifically, the present invention relates to an exercise device including multiple crossbars and a bracket, which conjunctively facilitate multiple exercises such as push-ups, sit-ups, leg lifts, step-ups, and the like.

One of the best forms of exercise to improve muscle tone and strength, as well as to increase overall fitness, is isometric weight training, in which the exerciser may use his or her own body weight as resistance against muscular movement. For example, a number of common upper-body and abdominal exercises utilize isometric resistance, including dips and push-ups for upper-body muscular development, and leg raises or crunches for abdominal muscles.

Isometric exercise apparatus are generally advantageous in that they do not necessitate the implementation of moving parts or supplemental weights for their utility, or a second person to spot the exerciser. However, isometric exercise apparatus are nevertheless typically quite heavy and bulky, and are usually not portable. In addition, these apparatus are commonly incorporated into expensive multi-station gyms, which occupy a substantial area of floor space. Accordingly, such exercise devices are often ill suited for home or office use because of their bulk and their non-portability.

Furthermore, these exercise machines are limited in their functionality because they are typically adapted for one type of exercise, such as push-ups or abdominal crunches. Therefore, there is a need for an affordable, easy-to-use, lightweight, and portable stand-alone exercise device which can be positioned underneath a door and secured thereto in order to perform a range of exercises including, for example, push-ups, dips, sit-ups, leg raises, and step-ups.

SUMMARY OF THE INVENTION

In view of the foregoing disadvantages inherent in the known types of exercise devices now present in the known art, the present invention provides an exercise device wherein the same can be utilized for providing convenience for the user when exercising.

In one example of the present invention, the exercise device comprises a an upright frame including a first support member and a second support member, each members including an upper end, a lower end, and a front and rear leg each including a first end and a second end. A first crossbar interconnects the upper end of the first support member to the upper end of the second support member, such that the first crossbar is perpendicular to the first and second support members. A second crossbar interconnects the upper end of the first support member to the upper end of the second support member, such that the second crossbar is perpendicular to the first and second support members. A third crossbar interconnects a middle portion of the rear leg of the first support member and a middle portion of the rear leg of the second support member, such that the third crossbar is perpendicular to the first and second support members. A fourth crossbar interconnects the second end of the front leg of the first support member and the second end of the front leg of the second support member. A bracket extending outwardly from the fourth crossbar includes a planar member and lip configured to receive a door rail. A height adjustment member coupled to a base of the each of the front legs is configured to extend vertically downwardly from the base of each of the front legs so as to adjust the height of each of the front legs. A first support arm and a second support arm extend horizontally outwardly from the upper end of the first support member and the second support member, respectively.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
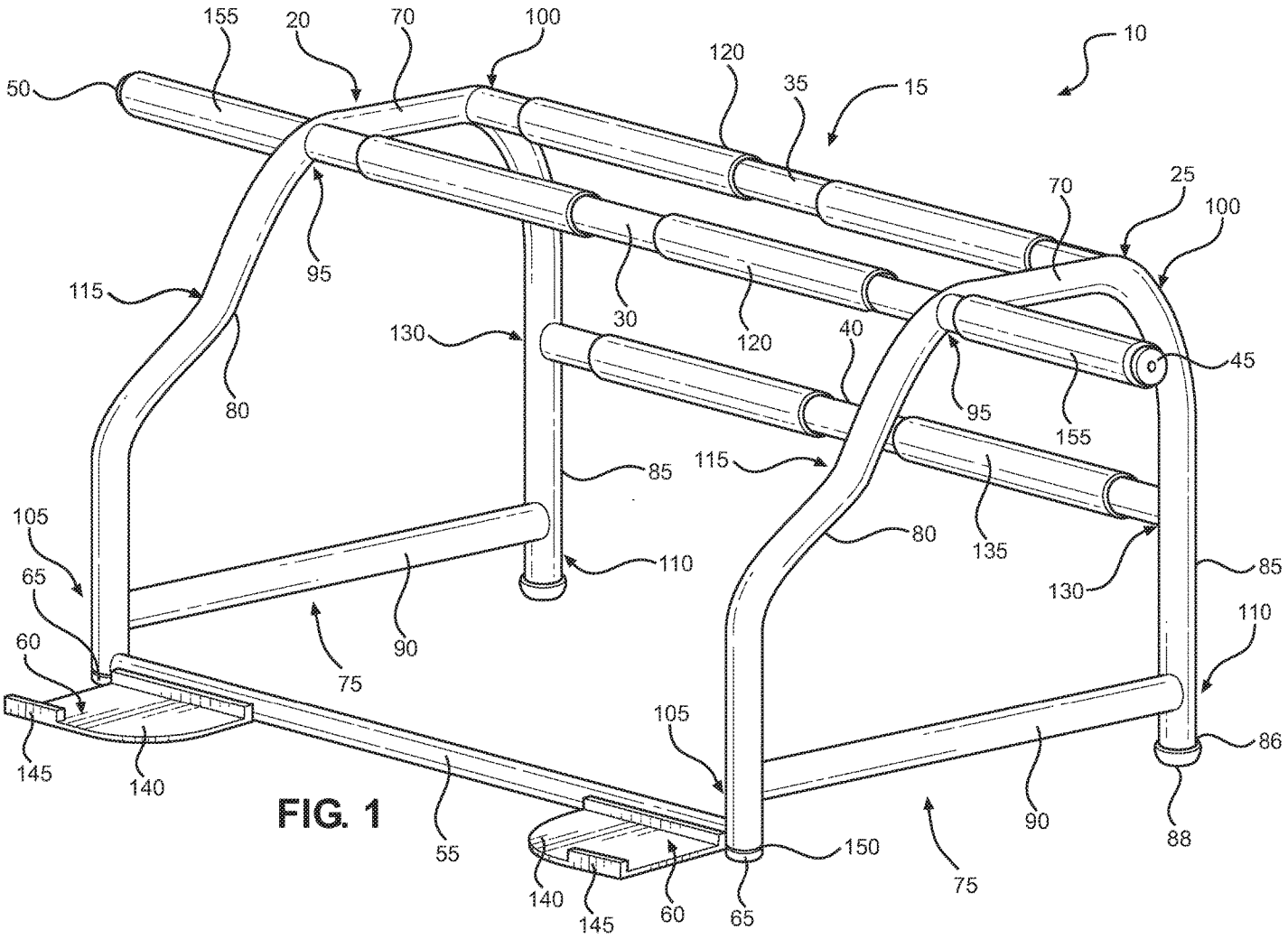
FIG. 1 shows a perspective front view of the multi-purpose exercise device.

Reference is made herein to the attached drawings. Like reference numerals are used throughout the drawings to depict like or similar elements of the multi-purpose exercise device. The figures are intended for representative purposes only and should not be considered to be limiting in any respect.

Figure 2:
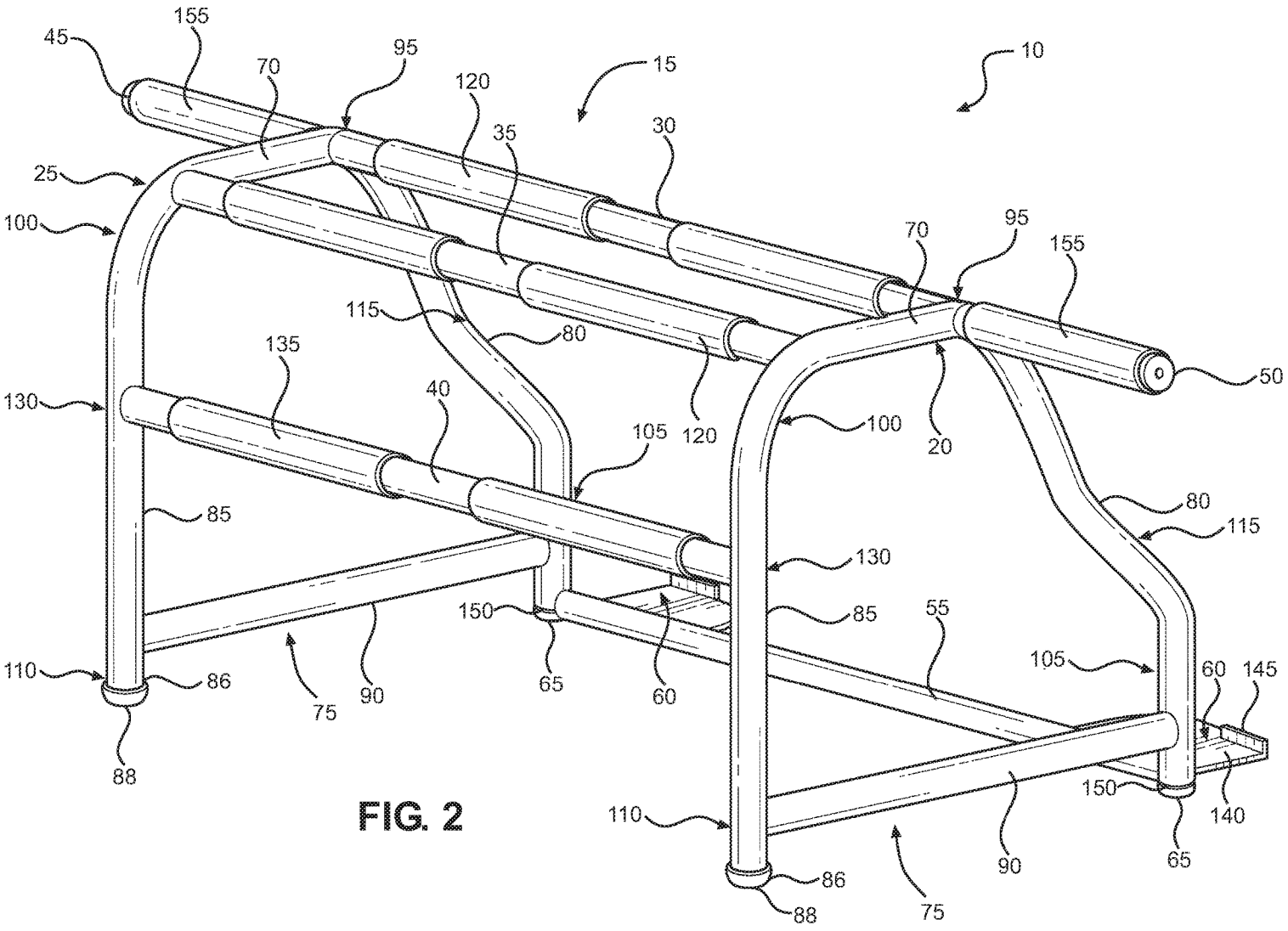
FIG. 2 shows a perspective rear view of the multi-purpose exercise device.

Referring now to FIGS. 1 and 2, there is shown a perspective front view of the multi-purpose exercise device and a perspective rear view of the multi-purpose exercise device, respectively. The present invention provides a multi-purpose exercise device 10 including various crossbars arranged so as to allow a user to engage in multiple different exercises utilizing the same exercise device 10. The multi-purpose exercise device 10 includes an upright frame 15 including a first support member 20 and a second support member 25 configured to support the exercise device 10 in an upright and freestanding position. A first crossbar 30, a second crossbar 35, and a third crossbar 40 are each oriented on the frame 15 such that the crossbars 30, 35, 40 conjunctively enable a user to perform push-ups, step-ups, and crunches with the same exercise device 10. The exercise device 10 further includes a first support arm 45 and a second support arm 50 for facilitating wide-grip push-ups, and a fourth crossbar 55 including a bracket 60 configured to engage the bottom rail, or bottom edge, of a door and secure and stabilize the exercise device 10 to the door in order to allow completion of exercises requiring the exercise bar 10 to be fixed in place. A height adjustment member 65 disposed on the support members 20, 25 is configured to extend vertically therefrom in order to adjust the height of the support members 20, 25.

The first and second support members 20, 25 each include an upper end 70, a lower end 75, a front leg 80, a rear leg 85, and a support bar 90, which are all coplanar relative to each other. In the depicted embodiment, each of the first and second support members 20, 25 are formed from a single unitary tubular member. The upper ends 70 of the support members 20, 25 extend horizontally and interconnect a first end 95 of the front legs 80 to a first end 100 of the rear legs 85. The support bar 90 extends horizontally across the lower end 75 and interconnects a second end 105 of the front legs 80 to a second end 110 of the rear legs 85, thereby providing support to the lower end 75 of the support members 20, 25, when the exercise device 10 is bearing weight. Each of the rear legs 85 extends vertically along a linear axis, such that the rear legs 85 are perpendicular relative to the upper end 70 of the support members 20, 25. In the depicted embodiment, each of the rear legs 85 includes a stopper 86 disposed at a base 88 thereof for gripping a surface. The stopper 86 is preferably composed of a high-friction material, such as, for example, rubber. Each of the front legs 80 includes an arcuate portion 115 extending, or curving, outwardly from the first end 95 of the front leg 80 to the second end 105 of the front leg 80. The curved portion 115 extends outwardly relative to the upper end 70, such that the first end 95 and the second end 105 of the front leg 80 are offset and disposed along different vertical planes.

The first crossbar 30 interconnects the upper end 70 of the first support member 20 to the upper end 70 of the second support member 25 adjacent the front legs 80, such that the first crossbar 30 is perpendicular to the first and second support members 20, 25. The second crossbar 35 interconnects the upper end 70 of the first support member 20 and the upper end 70 of the second support member 25 adjacent the rear legs 85, such that the second crossbar 35 is perpendicular to the first and second support members 20, 25. The first and second crossbars 30, 35 are aligned and parallel relative to each other along the same horizontal plane. The first and second crossbars 30, 35 are aligned and parallel to each other so that they form a level area in which a user can step onto when performing step-ups using the exercise device 10. In the depicted embodiment, the first and second crossbars 30, 35 each include a first pair of grips 120 for providing a user comfort and stability when utilizing either of the crossbars 30, 35. Each grip of the first pair of grips 120 extends annularly around its respective first and second crossbar 30, 35. In another embodiment, the first and second crossbars 30, 35 each include a grip extending along the length of each of the crossbars 30, 35.

Figure 3:
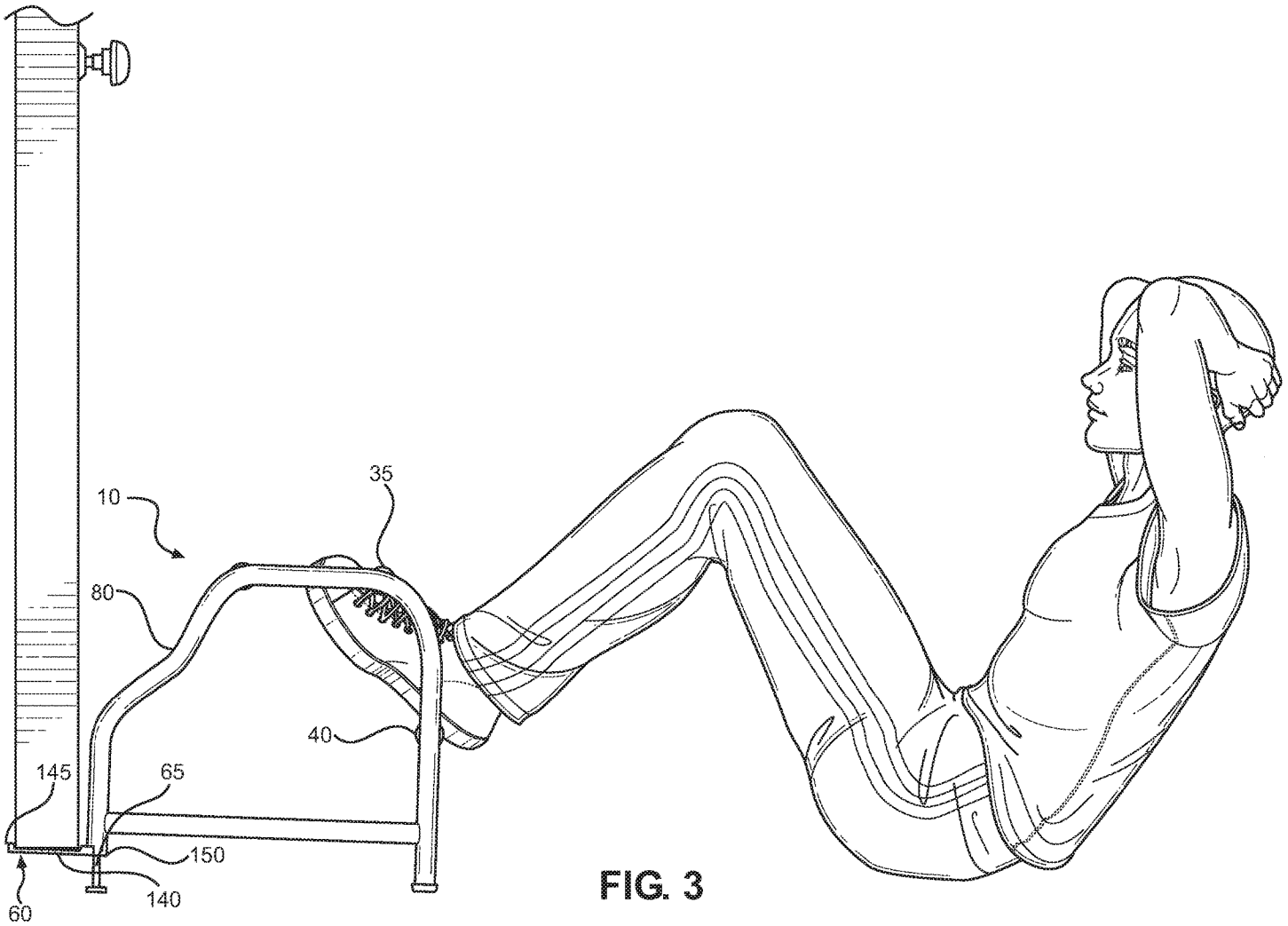
FIG. 3 shows a side view of the multi-purpose exercise device positioned underneath a door and in use.

The third crossbar 40 interconnects a middle portion 125 of the rear leg 85 of the first support member 20 and a middle portion 130 of the rear leg 85 of the second support member 25, such that the third crossbar 40 is perpendicular to the first and second support members 20, 25. In the depicted embodiment, the third crossbar 40 includes a second pair of grips 135 for providing a user comfort and stability when utilizing the third crossbar 40. The third crossbar 40 is configured to receive a user's feet when a user is performing sit-ups or crunches using the exercise device 10. For instance, in one use of the exercise device 10, a user places his or her heels on the third crossbar 40 and places his or her toes between the first crossbar and the second crossbar 35 in order to support the upper portion of his or her toes with the second crossbar 35, as shown in FIG. 3, such that the user may utilize the exercise device to perform sit-ups.

The fourth crossbar 55 interconnects the second end 105 of the front leg 80 of the first support member 20 and the second end 105 of the front leg 80 of the second support member 25, such that the fourth crossbar 55 is perpendicular relative to the first and second support members 20, 25. In the depicted embodiment, the bracket 60 comprises a pair of outwardly extending planar members 140 each including an upwardly extending lip 145 disposed at a distal end thereof. Each of the planar members 140 is sized to receive the bottom rail, or edge, of a door and secure it thereto in order to stabilize the exercise device 10 to the door when performing exercises requiring the exercise bar 10 to be fixed in place, such as crunches or sit-ups, as shown in FIG. 3. The lip 145 engages the front or rear face of the door rail and prevents the exercise device 10 from slipping out from under the door when in use.

The height adjustment member 65 is extendably coupled to a base 150 of each of the front legs 80 of the first and second support members 20, 25. The height adjustment member 65 is configured to extend vertically downwardly from the base 150 of the front legs 80 so as to extend the height the front legs 80 and the fourth crossbar 55 relative to the ground. In this way, the front legs 80 and the fourth crossbar 55 may be raised in order to engage a door that includes a door rail positioned at a greater height than an average door, as shown in FIG. 3. In the depicted embodiment, the height adjustment member 65 is threadably coupled to the base 150 of each the front legs 80, such that the height adjustment member 65 can extend and retract into the base 150 of each of the front legs 80 of the first and second support members 20, 25 via a twisting motion.

Figure 4:
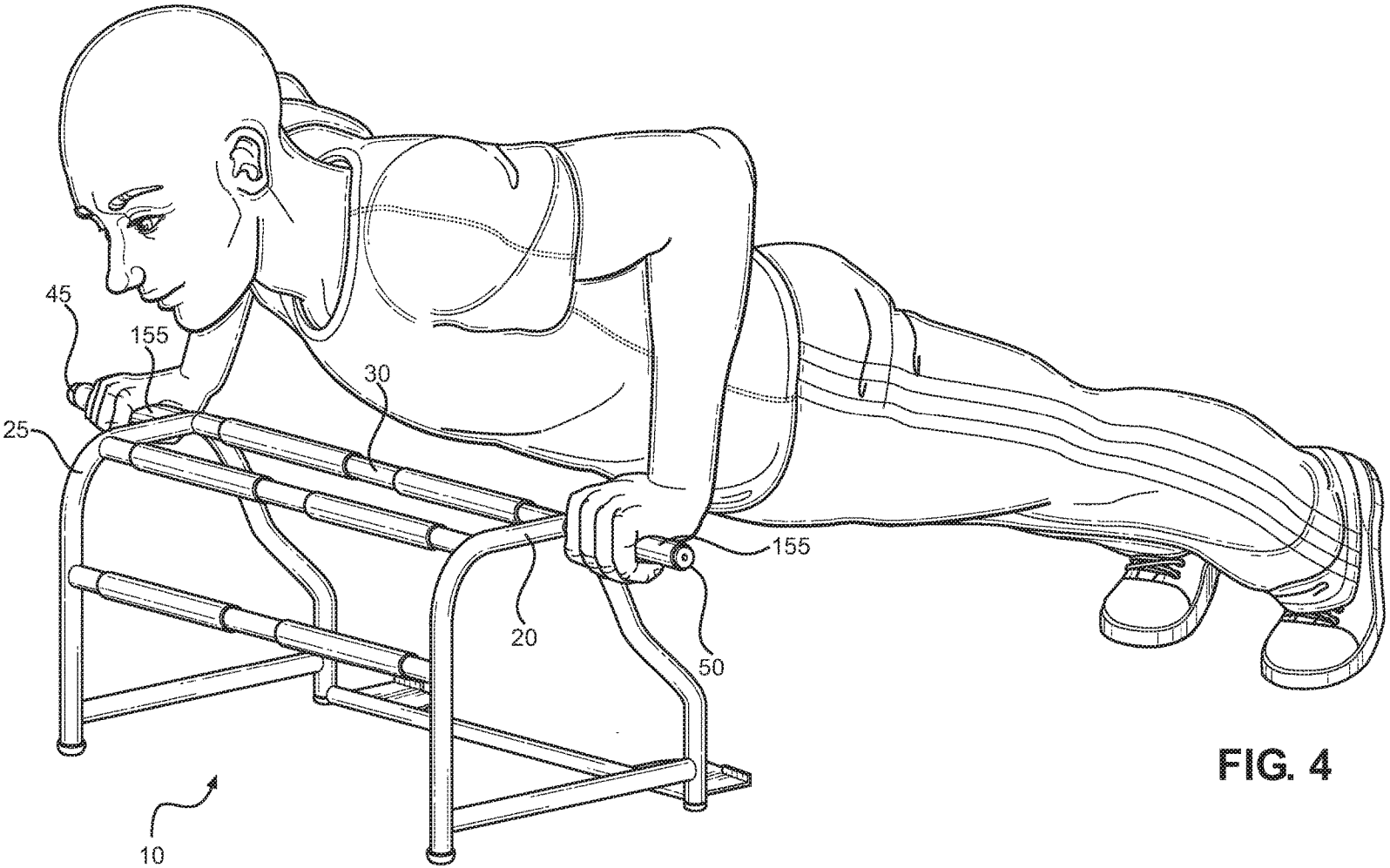
FIG. 4 shows a perspective view of the multi-purpose exercise device in use.

The first support arm 45 extends horizontally outwardly from the upper end 70 of the first support member 20 and the second support arm 50 extends horizontally outwardly from the upper end 70 of the second support arm 50. The first and second support arms 45, 50 are aligned with one another along a common longitudinal axis. In the depicted embodiment, the first and second support arms 45, 50 are aligned with the first crossbar 30 along a common longitudinal axis. The first and second support arms 45, 50 are configured to enable a user to perform wide-grip push-ups using the exercise device 10, as shown in FIG. 4. In the depicted embodiment, the first and second support arms 45, 50 each include a grip 155 for providing a user comfort and stability when utilizing the first and second support arms 45, 50.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An exercise device, comprising:

an upright frame including a first support member and a second support member, the first support member and the second support member each including an upper end, a lower end, a front leg, and a rear leg, the front leg and the rear leg each including a first end and a second end;

a first crossbar interconnecting the upper end of the first support member to the upper end of the second support member, the first crossbar perpendicular to the first support member and the second support member;

a second crossbar interconnecting the upper end of the first support member and the upper end of the second support member, the second crossbar perpendicular to the first support member and the second support member;

wherein the first crossbar and the second crossbar are aligned and parallel relative to each other along a horizontal plane;

a third crossbar interconnecting a middle portion of the rear leg of the first support member and a middle portion of the rear leg of the second support member, the third crossbar perpendicular to the first support member and the second support member;

a fourth crossbar interconnecting the second end of the front leg of the first support member and the second end of the front leg of the second support member, the fourth crossbar including a bracket extending outwardly therefrom, the bracket configured to receive a door rail;

a height adjustment member coupled to a base of the front leg of the first support member and a base of the front leg of the second support member, wherein each height adjustment member is configured to extend vertically downwardly from the base of its respective front leg so as to adjust the height of its respective front leg;

a first support arm extending outwardly from the upper end of the first support member; and a second support arm extending outwardly from the upper end of the second support member.

2. The exercise device of claim 1, wherein the upper end of the first support member extends horizontally and interconnects the first end of the front leg of the first support member and the first end of the rear leg of the first support member, and wherein the upper end of the second support member extends horizontally and interconnects the first end of the front leg of the second support member and the first end of the rear leg of the second support member.

3. The exercise device of claim 2, wherein the first support member further includes a first support bar extending across the lower end thereof, the first support bar interconnecting the second end of the front leg of the first support member and the second end of the rear leg of the first support member, and wherein the second support member further includes a second support bar extending across the lower end thereof, the second support bar interconnecting the second end of the front leg of the second support member and the second end of the rear leg of the second support member.

4. The exercise device of claim 2, wherein the rear legs of each of the first and second support members extend vertically along a linear axis, such that each of the rear legs of the first and second support members are perpendicular relative to the upper end of each of the first and second support members.

5. The exercise device of claim 1, wherein:

the front leg of the first support member includes a first arcuate portion extending from the first end of the front leg of the first support member to the second end of the front leg of the first support member, the first arcuate portion extending outwardly relative to the upper end of the first support member, such that the first end of the front leg of the first support member and the second end of the front leg of the first support member are offset and disposed along different vertical planes; and the front leg of the second support member includes a second arcuate portion extending from the first end of the front leg of the second support member to the second end of the front leg of the second support member, the second arcuate portion extending outwardly relative to the upper end of the second support member such that the first end of the front leg of the second support member and the second end of the front leg of the second support member are offset and disposed along different vertical planes.

6. The exercise device of claim 1, wherein the first crossbar and the second crossbar each include a pair of grips thereon.

7. The exercise device of claim 6, wherein the third crossbar includes a pair of grips thereon.

8. The exercise device of claim 1, wherein the bracket comprises a pair of planar members extending horizontally outwardly from the fourth crossbar, each planar member of the pair of planar members including a lip protruding vertically upwardly from a distal end thereof.

9. The exercise device of claim 1, wherein the height adjustment member is threadably coupled to a base of the front leg of the first support member and a base of the front leg of the second support member, the height adjustment member configured to extend and retract from the base via a twisting motion.

10. The exercise device of claim 1, wherein the first support arm and the second support arm are aligned with the first crossbar along a common longitudinal axis.

11. The exercise device of claim 10, wherein the first support arm and second support arm each include a grip thereon.

* * * * *